US005724774A

United States Patent [19]

Rooney

[11] Patent Number: 5,724,774

[45] Date of Patent: Mar. 10, 1998

[54] MODULAR BUILDING ASSEMBLY AND METHOD OF ASSEMBLING THE SAME

[76] Inventor: James W. Rooney, 12015 Corral Dr., Fairfax Station, Va. 22039

[21] Appl. No.: 667,599

[22] Filed: Jun. 21, 1996

Related U.S. Application Data

[63] Continuation-in-part of Ser. No. 279,010, Jul. 22, 1994, abandoned.

[51] Int. Cl.[6] ..... E04H 1/12

[52] U.S. Cl. ..... 52/79.5; 52/79.8; 52/79.9; 52/79.12; 52/79.13; 52/36.2; 52/271; 52/DIG. 17; 52/745.2

[58] Field of Search ..... 52/36.1, 36.2, 52/79.1, 79.5, 79.7, 79.8, 79.9, 79.12, 79.13, 270, 271, DIG. 17, 745.19, 745.2, 747.1

[56] References Cited

U.S. PATENT DOCUMENTS

| | | | |
|---|---|---|---|
| 975,692 | 11/1910 | Jeffers . | |
| 1,924,414 | 8/1933 | Ring . | |
| 2,751,635 | 6/1956 | Donnahue . | |
| 3,039,569 | 6/1962 | Sherron | 52/79.9 |
| 3,256,860 | 6/1966 | Parker | D25/16 X |
| 3,299,594 | 1/1967 | Kellert . | |
| 3,484,999 | 12/1969 | Ven der Lely . | |
| 3,501,875 | 3/1970 | Mailly . | |
| 3,512,316 | 5/1970 | Parr . | |
| 3,566,554 | 3/1971 | Schaffer et al. . | |
| 3,593,471 | 7/1971 | Fields . | |
| 3,643,689 | 2/1972 | Sheppley, Jr. . | |
| 3,690,077 | 9/1972 | Dalgliesh, Jr. et al. | 52/79.8 |
| 3,707,811 | 1/1973 | Hampson | 52/79.8 X |
| 3,838,545 | 10/1974 | Kump . | |
| 3,899,043 | 8/1975 | Hall | 52/79.9 X |
| 3,992,829 | 11/1976 | Schellberg et al. . | |
| 4,102,091 | 7/1978 | Farge . | |
| 4,505,078 | 3/1985 | Huh | 52/36.2 |
| 4,592,175 | 6/1986 | Werner | 52/79.9 |
| 4,637,179 | 1/1987 | Bigelow, Jr. et al. . | |
| 4,644,708 | 2/1987 | Baudot et al. . | |
| 4,726,155 | 2/1988 | Nahmias . | |
| 4,822,197 | 4/1989 | DeMartino . | |
| 4,854,094 | 8/1989 | Clark . | |
| 5,285,604 | 2/1994 | Carlin . | |

FOREIGN PATENT DOCUMENTS

| | | | |
|---|---|---|---|
| 1 523 458 | 3/1968 | France . | |
| 2 292 811 | 6/1976 | France . | |
| 2576624 | 8/1985 | France | 52/79.1 |
| 2 561 280 | 9/1985 | France . | |
| 1953109 | 8/1978 | Germany | 52/79.1 |
| 2 902 322 | 7/1980 | Germany . | |
| 3 441 773 | 7/1985 | Germany . | |
| 8 500 072 | 8/1986 | Netherlands . | |
| 2 232 171 | 12/1990 | United Kingdom . | |

*Primary Examiner*—Wynn E. Wood
*Assistant Examiner*—Laura A. Saladino
*Attorney, Agent, or Firm*—Foley & Lardner

[57] ABSTRACT

A building unit for providing shelter, storage space, and the like generally includes a floor panel, two side wall panels, two end panels, and a roof panel. The floor panel has a pair of floor supports extending along its exterior surface. The floor supports define a passageway therethrough for receiving air. Side brackets releasably mount the two side wall panels to the floor panel and roof panel. Roof brackets matingly engage upwardly extending flanges of the roof panel to stabilize the building structure and seal the interior of the building unit against leaks. The roof brackets also interlock with the side brackets to stabilize the building unit. A building unit may be erected adjacent to other building units to form a modular building assembly.

17 Claims, 9 Drawing Sheets

MODULAR BUILDING ASSEMBLY AND METHOD OF ASSEMBLING THE SAME

CROSS-REFERENCE TO RELATED APPLICATION

The present application is a continuation-in-part application of U.S. patent application Ser. No. 08/279,010, "QUICK ERECT SHELTER," Rooney, J., filed on Jul. 22, 1994, now abandoned. The disclosure of that application is expressly incorporated herein by reference in its entirety.

BACKGROUND OF THE INVENTION

This invention relates to a novel modular building assembly and method of assembling the same. More specifically, this invention relates to a novel modular building assembly which may be easily transported to natural disaster sites and then quickly erected to provide an enclosed area for temporary housing, storage space, and the like.

When a natural disaster, such as a tornado or hurricane, strikes a community, homes often are destroyed. In the past, house trailers have been transported to the natural disaster site to provide refuge for the people left homeless and work space for the relief workers. The house trailers are relatively large in size, for example, 10 feet by 40 feet or 10 feet by 60 feet.

Transportation of the house trailers to the natural disaster site has proven problematic, however. Private companies cannot transport the house trailers on the interstates because the companies do not have vehicles capable of hauling their bulk. Moreover, the size of the house trailers makes it difficult to maneuver them through tollbooths. Airlifting the house trailers to the natural disaster sites is extremely costly.

Another problem with house trailers is that, once permanent houses have been rebuilt, the house trailers often remain unattended at the shelter site. No government or private entity wants to pay for their removal. Left outside without adequate maintenance, the house trailers deteriorate to a condition that makes them unfit for reuse and prohibitively expensive to repair. The deteriorated house trailers then remain permanent fixtures of the community.

As an alternative to house trailers, tents have been erected at natural disaster sites. Tents, however, do not bear up well in the inclement weather in the days following a natural disaster. The tent skin often shreds from wind or blowing debris. Moreover, the tents are not set up for air conditioning, heating, food preparation, or running water.

While many prefabricated shelter constructions have been devised, they often require structural members of relatively long dimension, making transport of the disassembled shelter difficult. Further, prior prefabricated shelter arrangements often require special fasteners and expensive hardware in order to produce a shelter with desired rigidity and ruggedness. Various building structures and shelters appearing in the past have panels connected by fasteners, such as bolts, spikes, nails, rivets, or pins. Typical of such structures are the buildings shown in U.S. Pat. Nos. 1,924,414; 3,512,316; 3,566,554; 3,838,545; 3,992,829; 4,637,179; and 5,285,604. Because of the numerous attachment points between building panels, these buildings are difficult and time-consuming to assemble and disassemble. Some building structures have hinged panels connected to each other in accordion fashion, for example, as disclosed in U.S. Pat. No. 4,726,155. Although this type of building structure may be assembled relatively quickly at the natural disaster site, assembly of hinges to the panels, and subsequent assembly of the panels to each other, takes time at the production facility. Another type of building structure may be readily assembled without the use of nails, screws, bolts or the like, as disclosed in U.S. Pat. No. 3,802,134. This building, however, requires numerous latch members or clips to interlock adjacent panels. Other building structures include interlocking tongue-in-groove arrangements to connect adjacent panels, such as that disclosed in U.S. Pat. No. 3,299,594. However, this type of building structure has a ceiling construction that permits rain water to seep into the building.

The difficulties suggested in the preceding are not intended to be exhaustive but rather are among many which tend to reduce the effectiveness of prior art shelters. Other noteworthy problems may also exist; however, those presented above should be sufficient to demonstrate that such methods and apparatuses appearing in the past will admit to worthwhile improvement.

Accordingly, it is therefore a general object of the invention to provide a modular building assembly and method of assembling the same which will obviate or minimize difficulties of the type previously described.

It is a specific object of the invention to provide a modular building assembly which may be quickly assembled to provide temporary shelter in all climates.

It is another object of the invention to provide a modular building assembly which may be erected without nails, screws, bolts or the like, which requires only a minimum number of suitable bracket members to fasten the components of the modular building assembly together, and which does not require special tools for construction.

It is still another object of the invention to provide a modular building assembly which may serve as administrative space for relief workers, as storage space, or for any other function at a natural disaster site requiring an enclosed area.

It is a further object of the invention to provide a modular building assembly which may be constructed as a single unit or multiple adjoining units.

It is yet a further object of the invention to provide a modular building assembly which is lightweight yet strong, easy to transport and store, weather-resistant, leak proof, windproof, durable, reusable, inexpensive to manufacture, easy to maintain and mass produce, and which may be rapidly assembled and disassembled.

It is still a further object of the invention to provide a modular building assembly which utilizes a minimum of building materials to provide a maximum of structural integrity and strength.

SUMMARY OF THE INVENTION

A preferred embodiment of the invention which is intended to accomplish at least some of the foregoing objects includes a modular building assembly for providing shelter, storage space, and the like. The modular building assembly includes a plurality of building units with two end building units and at least one inner building unit. Each of the building units is configured for releasable engagement with an adjacent building unit.

Each building unit preferably has a floor panel. The floor panel has a pair of floor supports extending along a length of an exterior surface of the floor panel. At least one of the floor supports defines a passageway therethrough for receiving air. The floor supports abut the floor supports of adjacent building units so that they provide a passageway for air between the units.

Each building unit also has two side wall panels and a substantially planar roof panel. Each side wall panel has a lower end and an upper end and is releasably mounted to the floor panel. A first side wall panel is mounted along a first edge of the floor panel, and a second side wall panel is mounted along a second edge of the floor panel opposite the first edge.

The roof panel has upwardly extending flanges along a first edge and a second edge. The roof panel is releasably mounted to and extends over and rests atop the upper end of each side wall panel.

Each of the two end building units has an end panel with a lower end and an upper end. The lower end of a first end panel is releasably mounted to a third edge of the floor panel of one of the two end building units. The lower end of a second end panel is releasably mounted to a fourth edge of the floor panel of the other of the two end building units. The upper end of each end panel releasably mounts to and supports the roof panel of an associated end building unit.

The modular building assembly further includes a plurality of side brackets and plurality of roof brackets. Each side bracket is formed to be releasably mounted to a side wall panel. Each side bracket has a lip portion at a first end which is positioned adjacent the roof panel.

The roof brackets are formed for mating engagement with the upwardly extending flanges of the roof panels. Each roof bracket has a lip portion at a first end and a second end. The lip portions are formed for interlocking engagement with the lip portion of a side bracket.

The modular building assembly may also include an inner wall panel mounted between adjacent building units. The inner wall panel is releasably mounted to the floor panel and serves as a wall structure, separating the interior spaces of adjacent building units. The inner wall panel may include a door opening to allow passage between adjacent building units.

A method of assembling a building unit comprises the steps of providing a floor panel, a plurality of wall panels, a substantially zero-pitch roof panel, a plurality of side brackets, and a plurality of roof brackets. The floor panel is positioning on a ground surface, and first and second wall panels are mounted on adjacent edges of the floor panel to form a first end wall and a first side wall of the building unit. The roof panel is then positioned atop upper ends of the first end wall and the first side wall. After the roof panel is positioned, third and fourth wall panels are mounted between the floor panel and the roof panel to form a second end wall and a second side wall of the building unit. A side bracket is then mounted to each vertical edge of the first and second side walls. A roof bracket is mounted to edges of the roof panel located atop the first and second end walls. Finally, lip portions of each roof bracket is interlocked with lip portions of corresponding side brackets.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENTS

Figure 1:
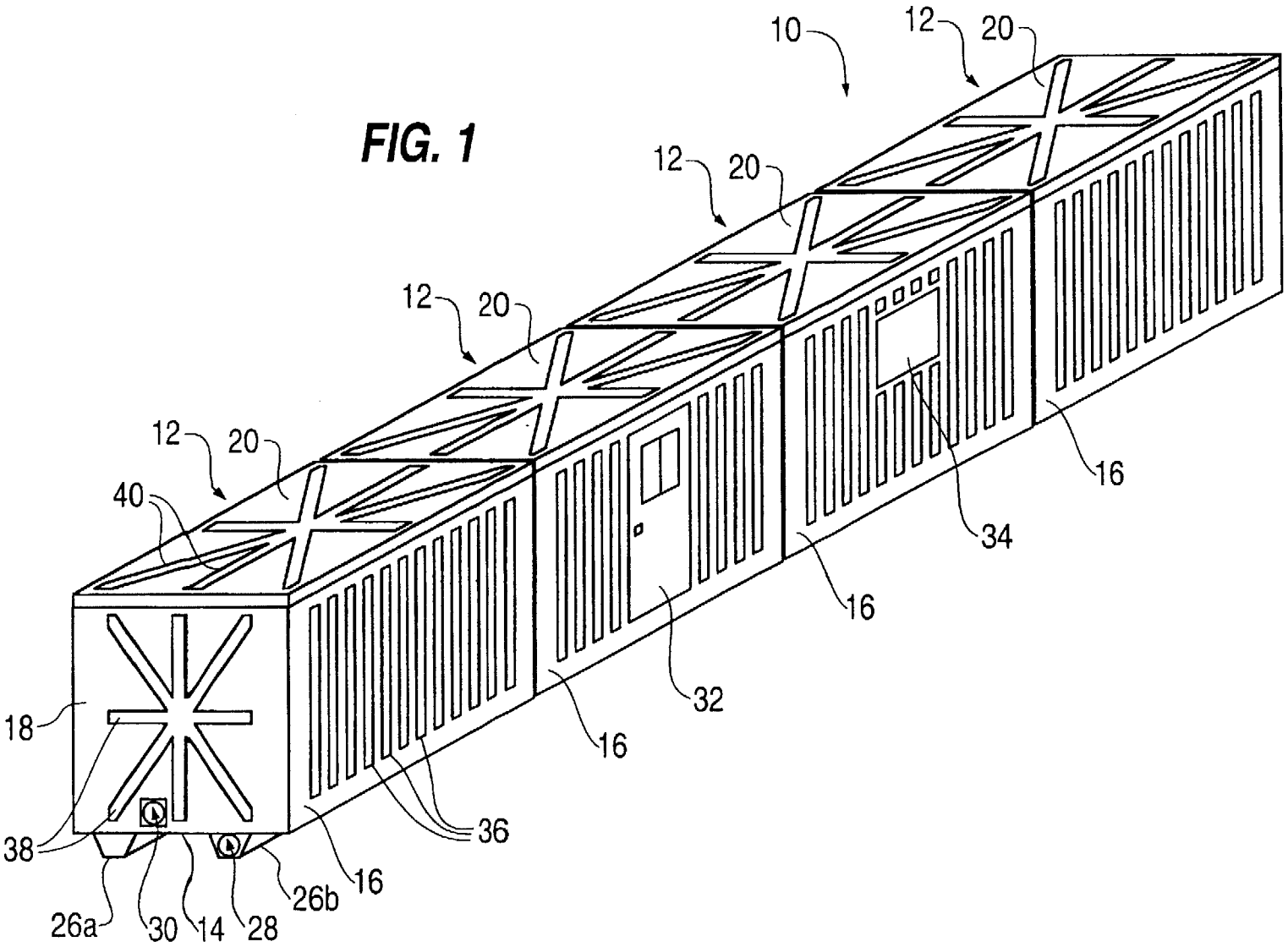
FIG. 1 is a perspective view of a modular building assembly assembled in accordance with the invention.

Referring now to the drawings, wherein like numerals indicate like parts, and initially to FIG. 1, there will be seen a modular building assembly, generally indicated 10, in accordance with the invention. Modular building assembly 10 includes a plurality of building units, each generally indicated 12, configured for releasable engagement with adjacent units. Although four building units 12 are shown in FIG. 1, it will be understood that any number of units may be adjoined together. Each building unit may provide a separate housing unit, or they may be interconnected via inner walls, or interior dividers, so that the entire assembly may function as space for a single family or organization, as will be described below.

Each building unit 12 preferably has a floor panel 14, two side wall panels 16, and a roof panel 20. End units of the modular building assembly 10 also include an end panel 18. Side wall panels 16 are releasably mounted to floor panel 14, as will be described in detail in connection with FIGS. 8 and 9. End panels 18 also are releasably mounted to an associated floor panel 14, as will be described in connection with FIG. 8. Roof panel 20 rests atop the upper ends of each of side wall panel 16 and, where present, the upper ends of each end panel 18. When assembled, building unit 12 provides a temporary shelter, administrative space, storage space, or the like. The units are adaptable to function as rooms of various types, such as kitchens, bathrooms, bedrooms, class rooms, and offices.

Each floor panel 14 has at least one floor support, or skid, extending along the length of the exterior surface of floor panel 14. In a preferred embodiment, two floor supports **26*a* and 26*b* extend in parallel along the exterior surface of floor panel 14, and at least one of the floor supports 26*b* defines a passageway 28 therethrough for receiving air from an external heating/cooling source. Vents (not shown) are positioned on floor panel 14 above floor support 26*b* so that air in passageway 28 can ventilate, heat, or cool the interior of building assembly 10. When building units 12 are positioned adjacent one another, floor supports 26*a* and 26*b* of adjacent building units interconnect. This enables air from the heating/cooling source to flow through the passageways of interconnected floor supports 26*b* to uniformly and evenly distribute air among the several building units. End panel 18 includes an outlet port 30 to permit the egress of air from the interior of the building assembly 10 back into a heating/cooling source, as will be discussed more fully in connection with FIGS. 15 and 16**.

Side wall panels 16 may include door openings 32 or window openings 34, depending upon the desired configuration of the modular building assembly 10. Side wall panels 16 preferably include longitudinally extending, reinforcing ribs 36. End panels 18 and roof panels 20 also preferably include reinforcing ribs 38 and 40, respectively. These reinforcing ribs do not add substantial thickness to the panels; the panels may be stacked flat atop each other for transportation or storage.

The panels of modular building assembly 10 may be dimensioned to fit in a stacked arrangement inside the trailer of a conventional military or civilian truck. The roof and side wall panels preferably are 9.6 feet by 7.4 feet. The end panels preferably are 7.4 feet by 7.4 feet. The floor panels are preferably 9.6 feet by 7.4 feet. A 40 foot trailer can hold four unassembled building units. This enables easy transportation of the modular building assembly to a natural disaster site. When a building unit is packaged in a stacked arrangement, it has a very compact size, and sixteen separate building units can fit inside the trailer of a 40 foot truck. It will be understood that the dimensions of the panels are approximate and may be changed to reflect the function of the inventive building assembly. Essentially any type truck can transport the subject modular building assembly, and the assembly may be hauled to remote areas, regardless of weather and terrain.

Figure 2:
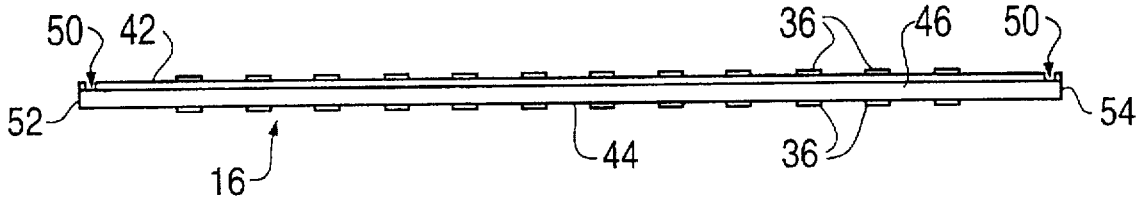
FIG. 2 is a top view of a side wall in accordance with the invention.
Figure 3:
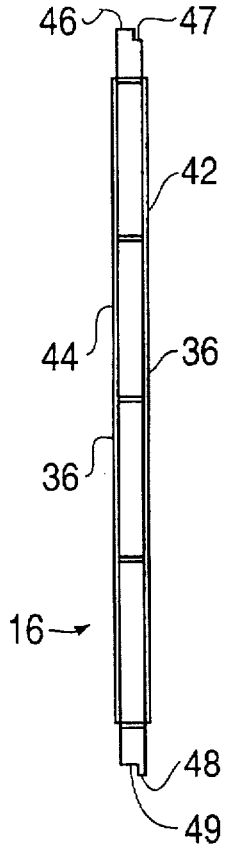
FIG. 3 is a side elevation view of a side wall panel in accordance with the invention.

FIG. 2 shows a top view of side wall panel 16, and FIG. 3 shows a side view of that panel. Reinforcing ribs 36 are mounted on an exterior surface 42 and interior surface 44 of side wall panel 16. Side wall panel 16 has an upwardly extending flange 46 that extends along the length of an upper end 47 of side wall panel 16 for interlocking engagement with a groove in roof panel 20. Upwardly extending flange 46 is coextensive with interior surface 44. Side wall panel 16 also includes a downwardly extending flange 48 that extends along the length of a lower end 49 of side panel 16 for interlocking engagement with a groove in floor panel 14. Side wall panel 16 further has grooves 50 that extend along the length of exterior surface 42 adjacent opposing side surfaces 52 and 54 of side wall panel 16. Grooves 50 are formed to receive side bracket members, as will be described in connection with FIG. 8.

Figure 4:
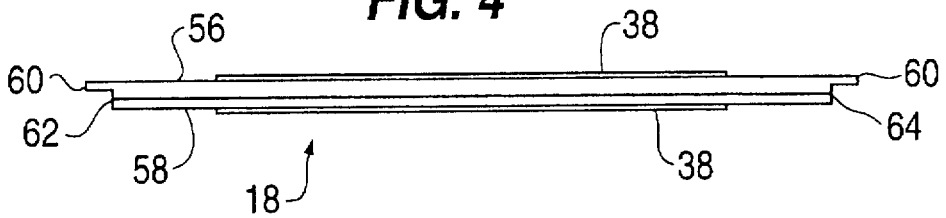
FIG. 4 is a top view of an end wall in accordance with the invention.
Figure 5:
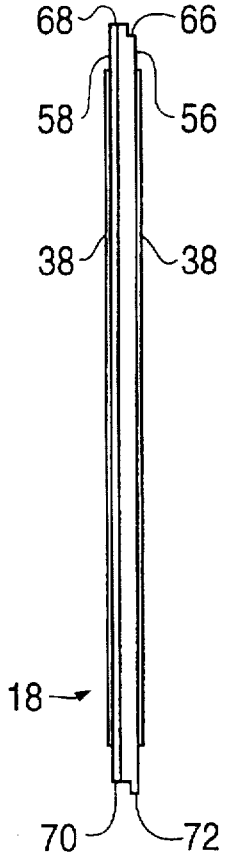
FIG. 5 is a side elevation view of an end wall in accordance with the invention.

FIG. 4 shows a top view of end panel 18, and FIG. 5 shows a side view of that panel. Like side wall panel 16, end panel 18 has reinforcing ribs 38 on an exterior surface 56 and interior surface 58. End panel 18 has opposing side flanges 60 that extend along the length of side surfaces 62 and 64 of end panel 18. Side flanges 60 are coextensive with exterior surface 56. Upper end 66 of end panel 18 has an upwardly extending flange 68 coextensive with interior surface 58 and formed for mating engagement with a groove in roof panel 20. Lower end 70 of end panel 18 has a downwardly extending flange 72 formed for mating engagement with a groove in floor panel 14.

Figure 6:
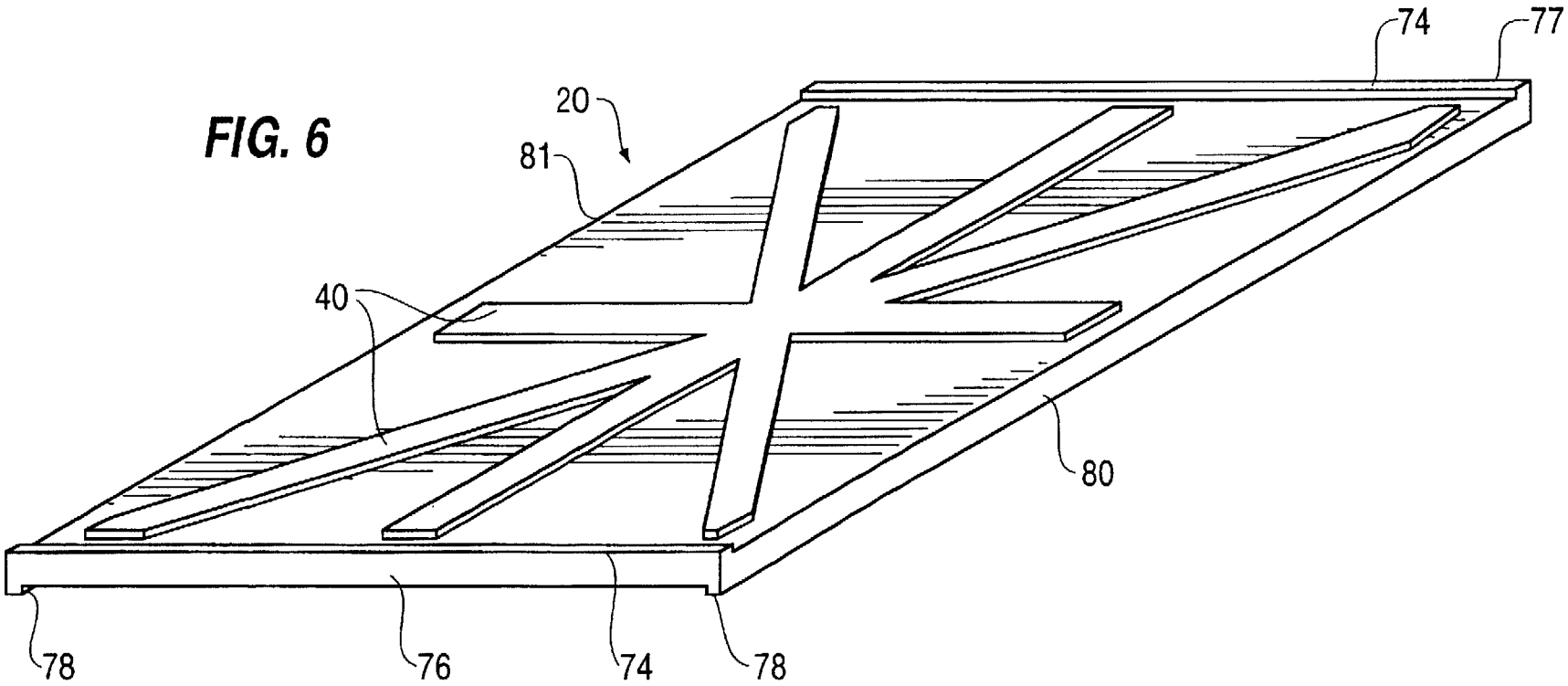
FIG. 6 is a top, perspective view of a roof panel in accordance with the invention.

Turning now to FIG. 6, roof panel 20 includes upwardly extending flanges 74 along a first edge 76 and a second edge 77 opposite first edge 76. Roof panel 20 also includes downwardly extending flanges 78 along a third edge 80 and a fourth edge 81 opposite third edge 80. Downwardly extending flanges 78 are positioned to extend over the upper end 47 of side wall panels 16 when roof panel 20 is mounted atop upper ends 47 and 66 of side wall panels 16 and end panels 18, respectively, as will be seen in FIG. 8. Roof panel 20 also includes grooves (not shown) along the bottom surface of first 76, second 77, third 80, and fourth 81 edges to receive upwardly extending flanges 46 and 68 of side wall panels 16 and end panels 18, respectively.

Roof panel 20 is substantially planar; that is, roof panel 20 does not include a crown. This enables roof panel 20 to be stacked flat with side wall panels 16, end panels 18, and floor panels 14 for transportation in a stacked arrangement in a trailer of a truck. Prepackaged for transport, each unit occupies a space less than 8 feet long and 10 feet wide. Roof panel 20 has reinforcing ribs 40 which add strength to, yet do not alter the substantially planar shape of, roof panel 20.

Figure 7:
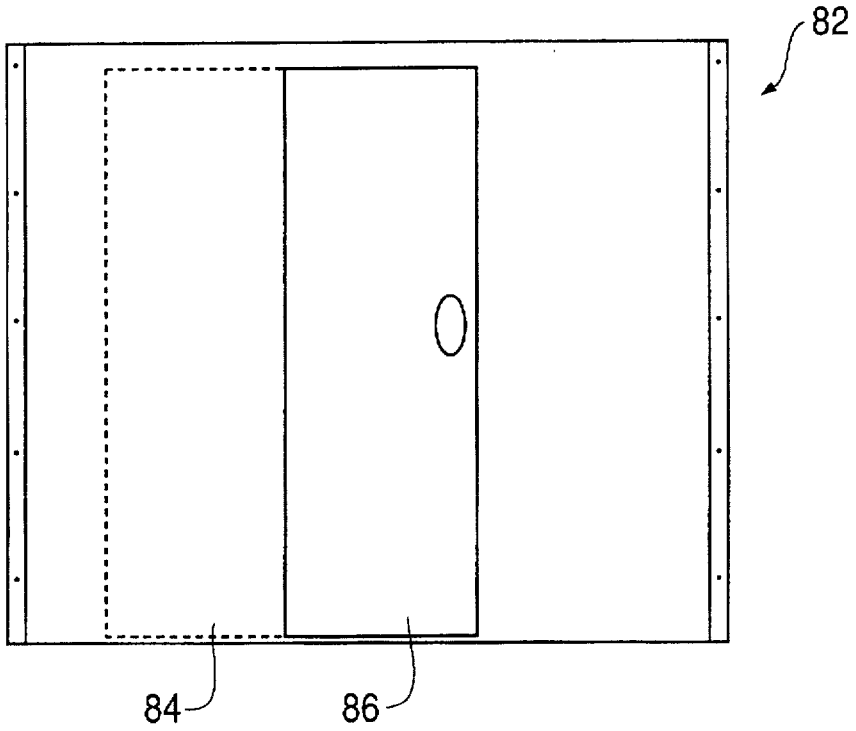
FIG. 7 is a front elevation view of an inner wall panel in accordance with the invention.

FIG. 7 shows an inner wall panel, generally indicated 82. Inner wall panel 82 has a configuration substantially identical to end panel 18; however, inner panel 82 may include a doorway 84 with a sliding door 86 to allow passage from the interior of one unit to the interior of an adjoining unit. Where a series of building units 12 are assembled side-by-side, an inner wall panel 82 may be mounted between adjacent units. The inner wall panel 82 is releasably mounted in grooves in adjacent floor panels in the same manner that end wall panels 18 are releasably mounted, as will be described in connection with FIG. 8. It will be understood that inner wall panel 82 need not have a doorway or other opening to adjoin separate rooms inside a building assembly 10. For example, inner wall panel 82 may be configured identically to end panel 18 so that families may be placed in adjacent, yet separate and private, units. Alternatively, where one family occupies several units, inner wall panels may include a doorway and serve to divide the modular building assembly into different living spaces.

Panels 14, 16, 18, 20, and 82 preferably include an outer shell composed of a plastic material. The plastic shell is filled with a foam insulation, such as polyurethane foam. This construction provides temperature and sound insulation, as well as providing more rigidity than a solid metal construction. Moreover, the panels are lightweight, reusable, and weather-resistant.

A method of assembling a building unit 12 in accordance with the invention will now be described. As will be seen in FIG. 8, building unit 12 includes floor panel 14, two side wall panels **16*a* and 16*b*, two end panels 18*a* and 18*b*, and roof panel 20. Building unit 12** may be quickly and easily erected because assembly of the unit does not require pins, bolts or other fasteners, or special tools commonly required for building construction.

Initially, floor panel 14 is placed on a ground surface at a desired location. Floor supports 26*a* and 26*b* elevate bottom surface 88 of floor panel 14 above the ground. Floor panel 14 has a first edge 92 and a second edge 100 to which are mounted side wall panels 16*a* and 16*b*, respectively. Floor panel 14 also has a third edge 94 and a fourth edge 104 to which are mounted end panels 18*a* and 18*b*, respectively. A vent 90 located in floor panel 14 above passageway 28 permits the flow of air from passageway 28 into the interior of the building unit.

Figure 9:
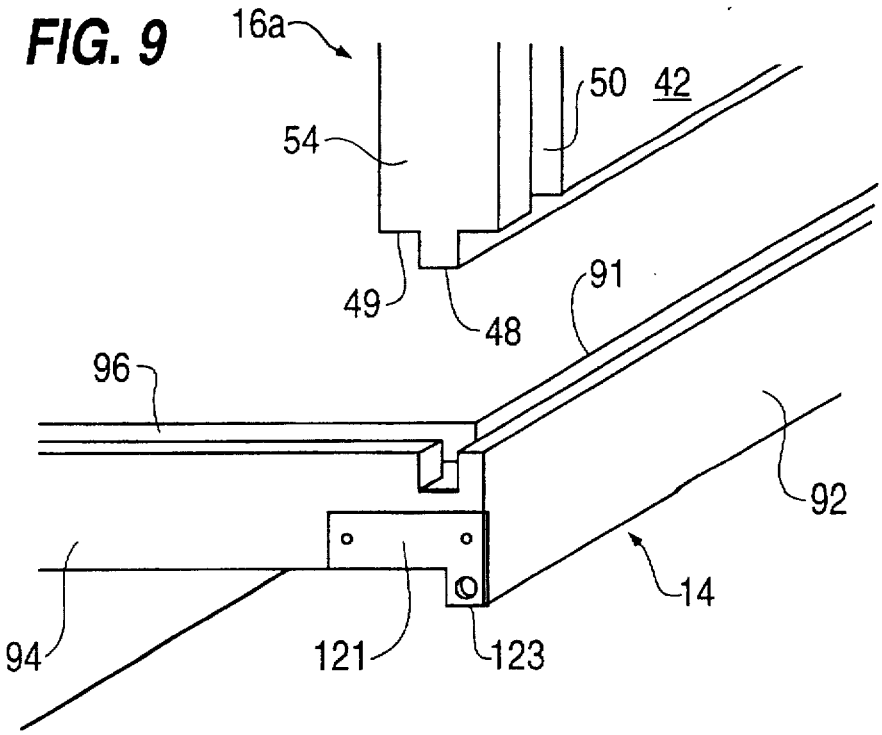
FIG. 9 is an enlarged, perspective view of the interlocking arrangement of a side wall panel with a floor panel in accordance with the invention.

Once floor panel 14 is positioned, a side wall panel 16*a* is mounted to floor panel 14. As shown in FIG. 9, downwardly extending flange 48 of side wall panel 16*a* interlockingly engages groove 91 on a first edge 92 of floor panel 14 to mount side wall panel 16*a* to floor panel 14. The weight of side wall panel 16*a* rests squarely on floor panel 14. The interlocking engagement of flange 48 and groove 91 ensure that side wall panel 16*a* will not blow out or in under windy conditions. This is true for all the interlocking engagements between the panels of the subject building assembly. Turning back to FIG. 8, side wall panel 16*a* is mounted so that upwardly extending flange 46 faces the interior of building unit 12.

Next, an end panel 18*a* is mounted to a third edge 94 of floor panel 14. Downwardly extending flange 72 of end panel 18*a* interlockingly engages groove 96 on third edge 94 of floor panel 14.

Roof panel 20 is then mounted atop upper end 47 of side wall panel 16*a* and upper end 66 of end panel 18*a*. Grooves on the under side of first edge 76 and third edge 80 of roof panel 20 interlockingly engage upwardly extending flanges 68 and 46 of end panel 18 and side wall panel 16, respectively. While roof panel 20 rests atop the upper ends of only two panels, a worker typically supports the unsupported, free corner of roof panel 20.

Figure 10:
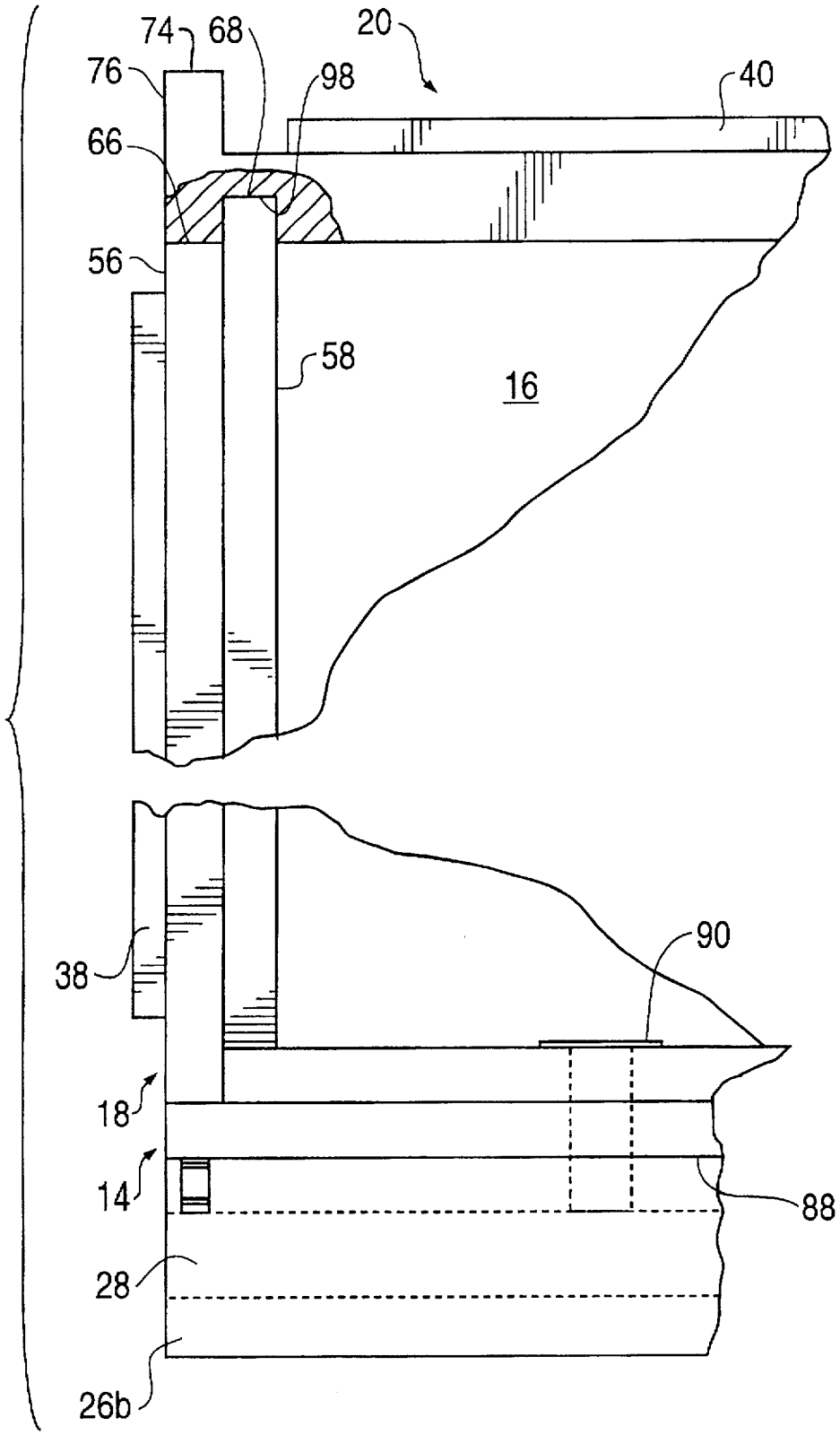
FIG. 10 is a side view, in partial cross section, of an end panel mounted between a floor panel and a roof panel in accordance with the invention.

FIG. 10 shows an end panel 18 mounted between floor panel 14 and roof panel 20. The mating engagement of roof panel 20 with end panel 18 prevents water leakage into the interior of building unit 12. End panel 18 is mounted so that upwardly extending flange 68 faces the interior of building unit 12. Groove 98 in first edge 76 of roof panel 20 receives upwardly extending flange 68 of end panel 18. Roof panel 20 has grooves like groove 98 on the underside of second 77, third 80, and fourth 81 edges to interlock with the upwardly extending flanges of the corresponding side wall panel and end wall panels. Roof panel 20 extends over the upper end 66 of end panel 18, as well as the upper end of the adjacent side wall panels and the opposite end panel. This interlocking arrangement of the end panel and side wall panel flanges and roof grooves creates a water-tight seal around the perimeter of the roof.

Once roof panel 20 is positioned, a second side wall panel 16*b*, configured substantially similar to side wall panel 16*a*, is mounted between floor panel 14 and roof panel 20. First and second side wall panels 16*a* and 16*b* are mounted in the same fashion. Downwardly extending flange 48 of side wall panel 16*b* interlockingly engages a groove 99 in second edge 100 of floor panel 14, and upwardly extending flange 46 of side wall panel 16*b* interlockingly engages a groove in fourth edge 81 of roof panel 20.

End panel 18*b* is mounted between roof panel 20 and floor panel 14 to complete the assembly of the panels of building unit 12. Downwardly extending flange 72 of end panel 18*b* interlockingly engages groove 102 on fourth edge 104 of floor panel 14. Upwardly extending flange 68 interlockingly engages a groove in second edge 77 of roof panel 20.

Figure 8:
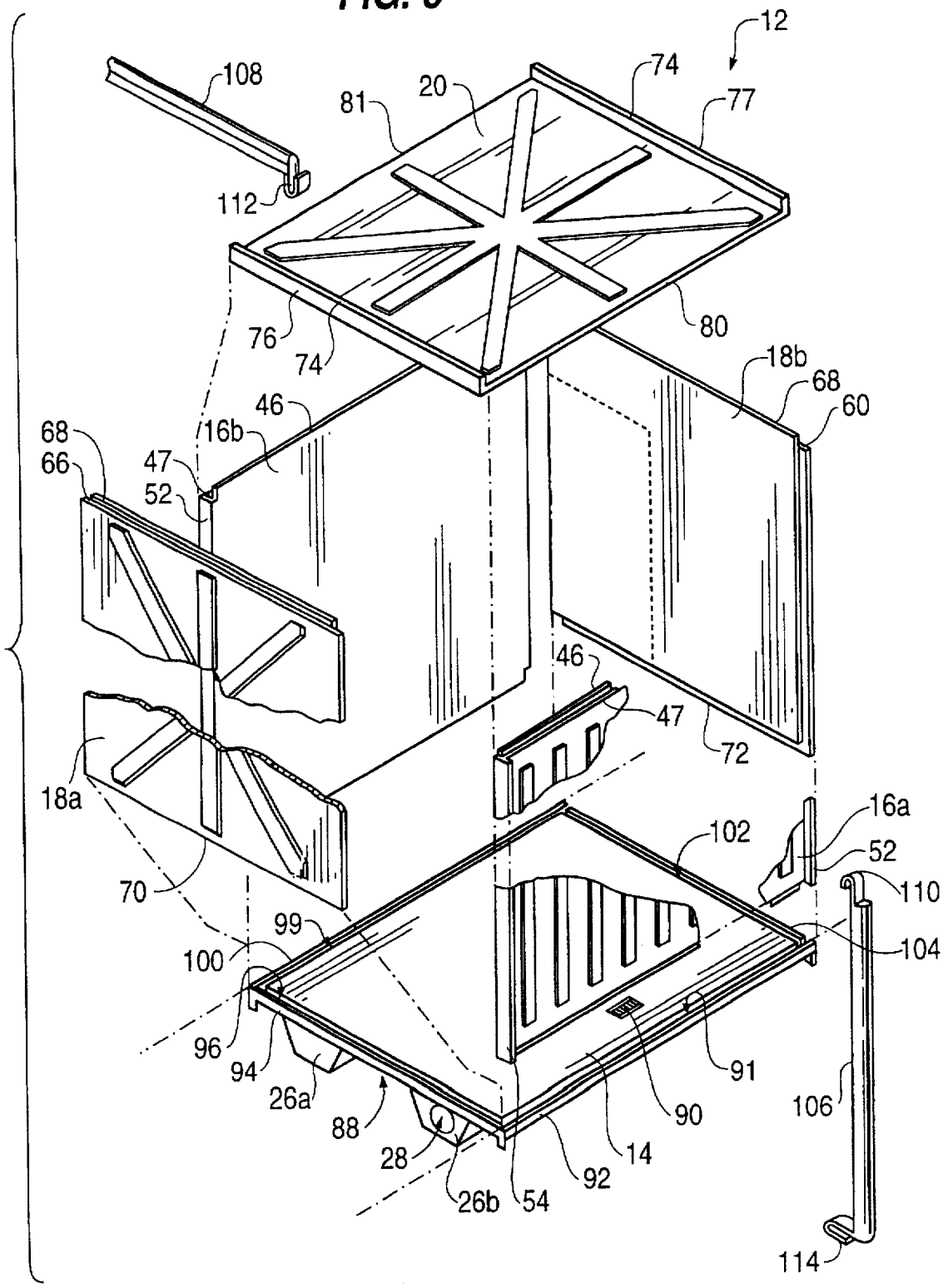
FIG. 8 is an exploded view of a building unit constructed in accordance with the invention.
Figure 12:
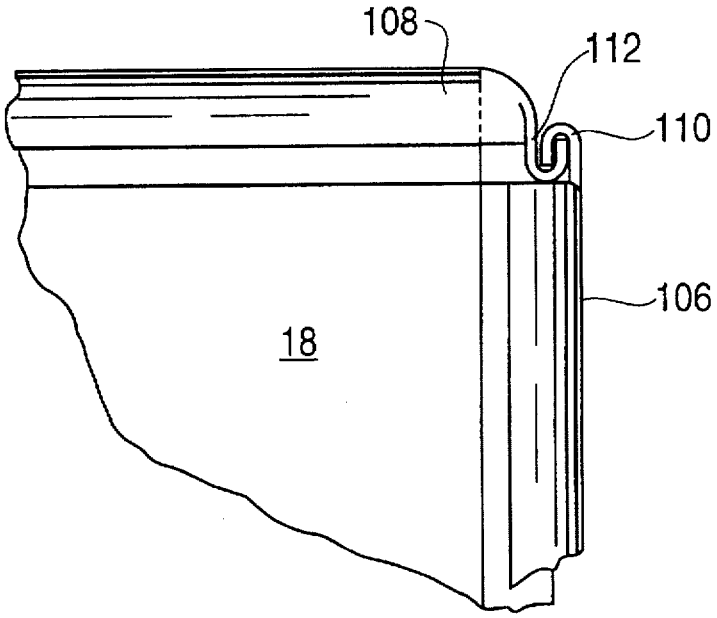
FIG. 12 is a side elevation view of a side wall panel and roof panel attached by brackets in accordance with the invention.

Next, side brackets 106 and roof brackets 108 are mounted to building unit 12. Side brackets 106 are dimensioned to extend from roof panel 20 to floor panel 14. Side brackets 106 are positioned along first and second edges 52 and 54 of side wall panels 16*a* and 16*b*. At a first end, side bracket 106 includes a downwardly curving lip 110 for positioning adjacent roof panel 20, as shown in FIGS. 8 and 12. Roof bracket 108, generally dimensioned to extend the width of roof panel 20, includes an upwardly curving lip 112 at its first and second ends for mating engagement with downwardly curving lip 110 of an associated side bracket 106. FIG. 12 shows the mating engagement of lip portions 110 and 112. Side brackets 106 and roof brackets 108 serve to stabilize roof panel 20, side wall panels 16, and end panels 18 from movement due to wind or other external forces. Brackets 106 also serve to prevent leakage at the junctions of side wall panels 16.

Figure 11:
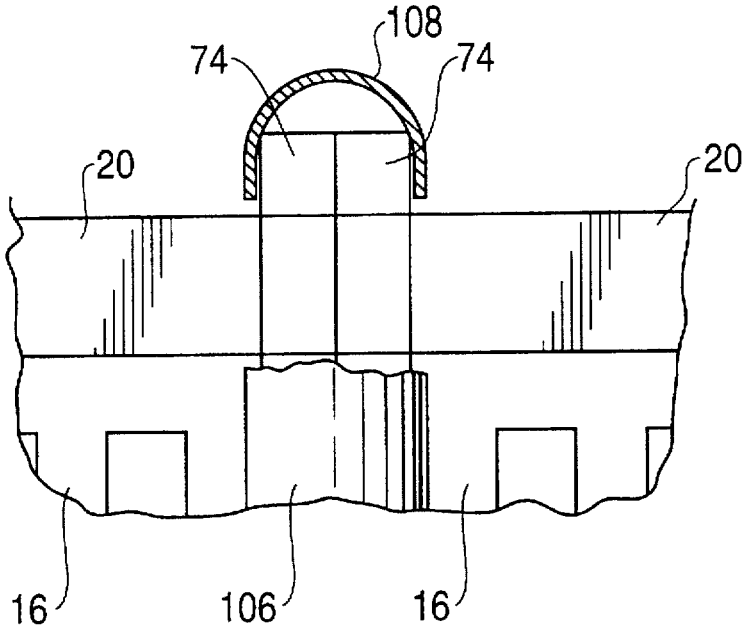
FIG. 11 is a side elevation view of two roof panels mounted to each other by a roof bracket in accordance with the invention.

Roof bracket 108 has a generally U-shaped cross section, as shown in FIG. 11. Roof bracket 108 is dimensioned to fit over upwardly extending flanges 74 of adjacent roof panels 20 when building units are mounted adjacent each other to form a modular building assembly. Roof bracket 108 prevents water leakage between adjacent roof panels and adds structural stability to the building assembly. When roof bracket 108 is mounted over a single, upwardly extending flange 74 (for example, as would occur in FIG. 8), the roof bracket 108 overhangs the flange 74 and provides extra protection against leakage.

Figure 13:
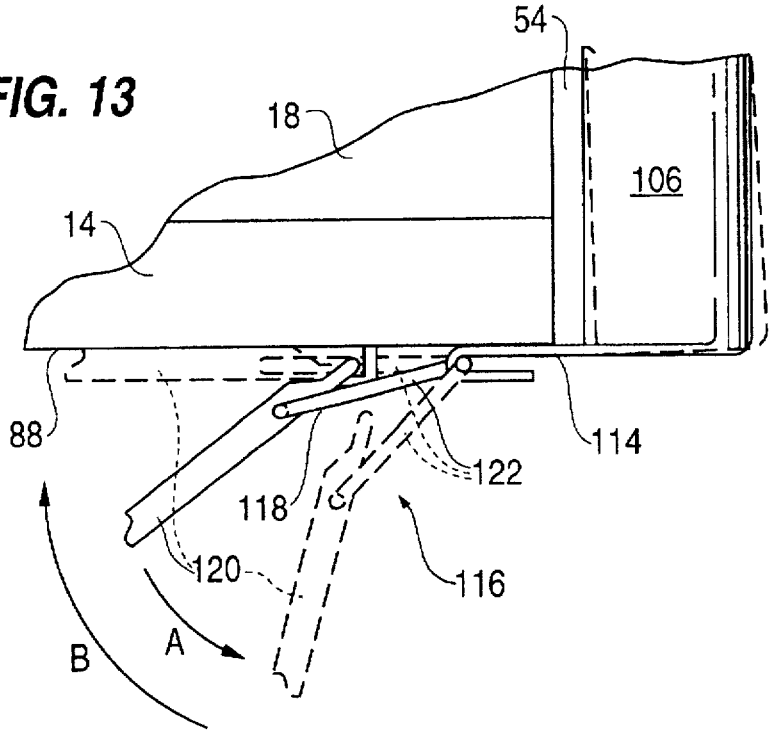
FIG. 13 is a side elevation view of a side wall panel latched to a floor panel in accordance with the invention.

Side brackets 106 also include a latching portion 114 at a second end for positioning adjacent floor panel 14, as shown in FIG. 13. Latching portion 114 is positioned for engagement with tension mechanism, generally indicated 116, located on a lower surface 88 of floor panel 14. Tension mechanism 116 includes a bracket 118, a lever 120, and a loop 122 for engaging latching portion 114. Lever 120 may be manually moved to move tension mechanism 116 from an open position (shown in solid lines) to a latched position (shown in shadow lines) in the direction of arrow A. Lever 120 may then be moved in the direction of arrow B to move tension mechanism 116 to a fully closed position so that lever 120 rests against lower surface 88 of floor panel 14. This moves latching portion 114 of side bracket 106 closer to floor panel 14 and, consequently, produces a tighter fit between side wall panel 16 and end panel 18. In other words, side bracket 106 moves from a first position (shown by shadow lines) to a tightened position (shown by solid lines).

Figure 14:
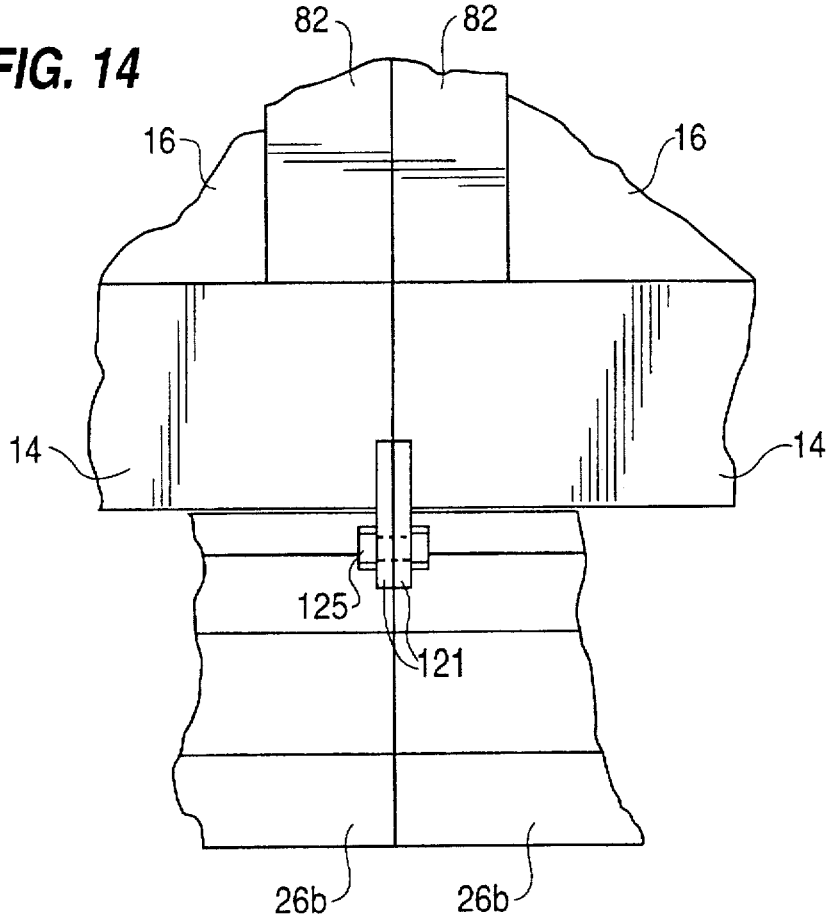
FIG. 14 is a front elevation view of adjacent floor panels mounted together.

FIG. 14 shows an additional optional feature of modular building assembly 10. Floor panels 14 may include an L-shaped bracket 121, as seen in FIG. 9, mounted to the third 94 and fourth 104 edges of floor panel 14. L-shaped brackets 121 have an opening 123 therethrough for receiving a bolt or screw or other fastener 125, as shown in FIG. 14. In this manner, adjacent floor panels 14 may be fastened together for added structural stability.

The method of assembling a modular building assembly with multiple building units essentially involves repeating the above steps with slight modifications. Inner wall panels 82 may be mounted between individual units, depending on the desired configuration assembly of the building.

When fully assembled, each building unit 12 measures approximately 8 feet by 10 feet. Each modular unit may be connected to another modular unit of similar size, as shown in FIG. 1. Alternatively, interconnected modular units may be of different sizes with different functions and include various living spaces, storage space, or administrative space.

Assembly of a four-unit modular building assembly, for example as shown in FIG. 1, takes approximately thirty minutes. Disassembly requires even less time. Because assembly and disassembly takes such little time, any damaged panels may be quickly replaced. The easy upkeep of the subject building assembly reduces the likelihood of it falling into disrepair.

Figure 15:
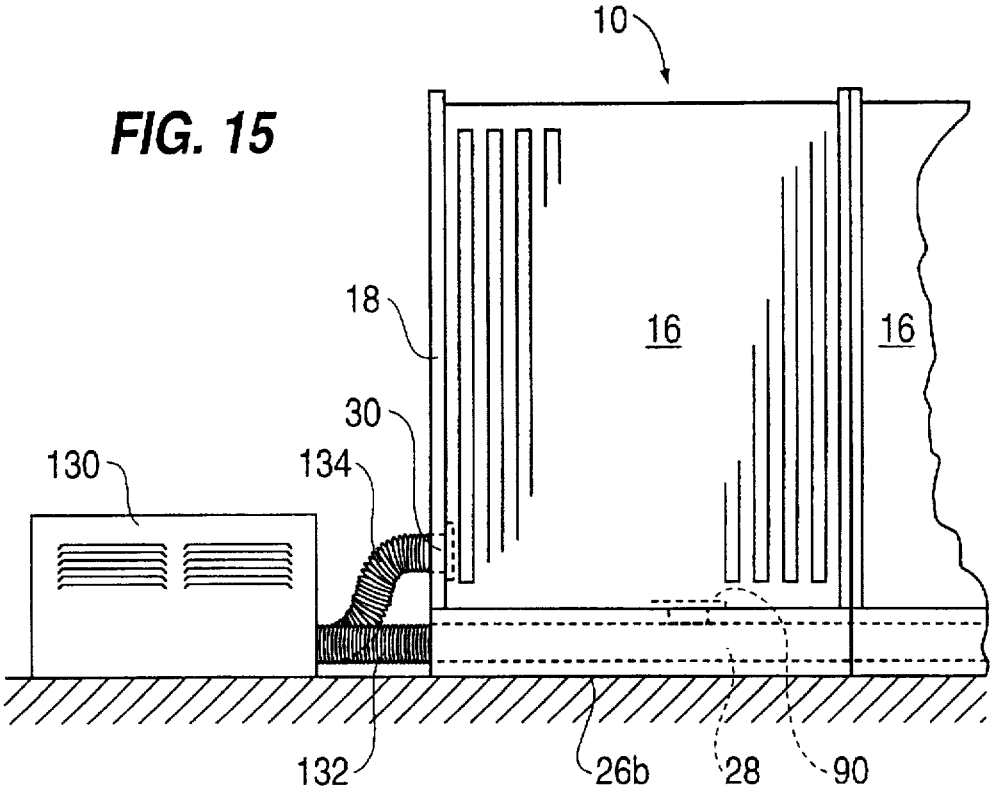
FIG. 15 is a side elevation view of a heating/cooling unit mounted to a building unit in accordance with the invention.

FIG. 15 shows an external, heating/cooling, ground unit 130 connected to outlet port 30 in end panel 18 of a multi-unit building assembly 10. Heating/cooling unit 130 provides external climate control for the interior of building assembly 10. An inlet line 132 runs from heating/cooling unit 130 to passageway 28 of floor support **26*b* to feed air from heating/cooling unit 130 into an interior of building assembly 10. A return line 134 of heating/cooling unit 130 receives air from the interior of building assembly 10. The interconnection of floor supports 26*b* of adjacent building units ensures uniform air distribution to the entire building assembly 10**.

Figure 16:
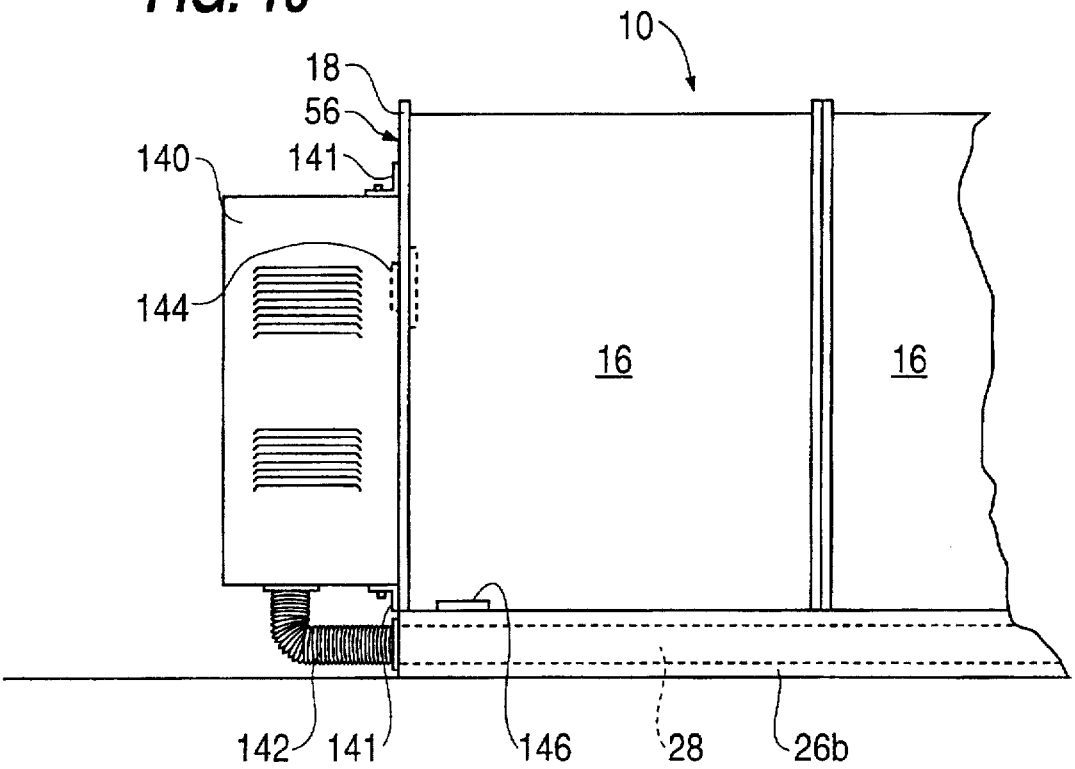
FIG. 16 is a side elevation view of an alternative arrangement of mounting a heating/cooling unit to a building unit in accordance with the invention.

FIG. 16 shows an alternative mounting arrangement for external, heating/cooling unit 140. Heating/cooling unit 140 is vertically mounted to outer surface 56 of end panel 18 by brackets 141. Like unit 130 shown in FIG. 15, an inlet line 142 feeds air from heating/cooling unit into an interior of building assembly 10 in a passageway 28 of floor support **26*b*. Heating/cooling unit 140 has a return port 144 for receiving air from the interior of building unit 10**.

The panels of the subject modular building assembly may be pre-wired for electricity. Heating/cooling unit 140 preferably also has an electric feed line (not shown) that feeds electricity to each of the building units. The feed line electrically communicates with an electric junction box 146 positioned in each unit.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A modular building assembly for providing shelter or storage space, comprising:

a plurality of building units including two end building units and at least one inner building unit, each of said building units configured for releasable engagement with an adjacent one of said plurality of building units, each of said building units having a floor panel, said floor panel having a pair of floor supports extending along a length of an exterior surface of said floor panel, at least one of said floor supports defining a passageway therethrough for receiving air, said floor supports of each of said building units positioned to abut said floor supports of an adjacent one of said building units so that said at least one of said floor supports of adjacent ones of said building units is able to communicate for passage of air, two side wall panels each having a lower end and an upper end, each of said two side wall panels formed to be releasably mounted to said floor panel, a first of said two side wall panels formed for mounting along a first edge of said floor panel and a second of said two side wall panels formed for mounting along a second edge of said floor panel opposite said first edge of said floor panel, and a roof panel having upwardly extending flanges along a first edge and a second edge thereof, said first edge of said roof panel being opposite said second edge of said roof panel, said roof panel formed to releasably mount to and extend over said upper end of each of said two side wall panels, said roof panel formed for operably resting atop said upper end of each of said two side wall panels, said roof panel being substantially planar;

each of said two end building units having an end panel with a lower end and an upper end, said lower end of a first end panel formed to be releasably mounted to a third edge of said floor panel of one of said two end building units, said lower end of a second end panel formed to be releasably mounted to a fourth edge of said floor panel of the other of said two end building units, said upper end of each said end panel formed to releasably mount to and support said roof panel of an associated one of said two end building units;

a plurality of side brackets each formed to be releasably mounted to said two side wall panels of said building units, each of said side brackets having a lip portion at a first end thereof, said first end formed to be positioned adjacent said roof panel of an associated one of said building units; and a plurality of roof brackets each formed for mating engagement with said upwardly extending flanges of each said roof panel, each of said roof brackets having a lip portion at a first end and a second end thereof, said lip portion of each of said roof brackets formed for interlocking engagement with said lip portion of one of said side brackets.

2. A modular building assembly as defined in claim 1 wherein said side brackets further comprise a latching member at a second end thereof, said second end of each of said side brackets formed to be positioned adjacent said floor panel of an associated one of said building units.

3. A modular building assembly as defined in claim 2 and further comprising a tension mechanism formed for mounting to said exterior surface of said floor panel of an associated one of said building units, said tension mechanism formed to be mounted for interlocking engagement with said latching member of an associated one of said side brackets.

4. A modular building assembly as defined in claim 1 wherein said lip portion of each of said side brackets comprises a downwardly curving lip, and said lip portion of each of said roof brackets comprises an upwardly curving lip formed for releasable engagement with said downwardly curving lip.

5. A modular building assembly as defined in claim 1 wherein said roof brackets are formed for releasably connecting said roof panel of each of said two end building units to said roof panel of said at least one inner building unit, said roof brackets formed for positioning around adjacent ones of said upwardly extending flanges to form a seal therebetween.

6. A modular building assembly as defined in claim 1 further comprising a temperature control device, attached to said at least one of said floor supports, for delivering temperature controlled air to said interior of each of said building units via vents.

7. A modular building assembly as defined in claim 6 wherein said temperature control device has a temperature control unit and an inlet line, said inlet line having a first end for attachment to said temperature control unit and a second end for attachment to said at least one of said floor supports.

8. A modular building assembly as defined in claim 1 wherein said floor panel, said roof panel, said two side wall panels, and said end panel are substantially planar and packageable in a stacked arrangement.

9. A modular building assembly as defined in claim 1 wherein said roof panel and each of said two side wall panels are dimensioned approximately 9.6 feet by approximately 7.4 feet.

10. A modular building assembly as defined in claim 1 wherein said end panel is dimensioned approximately 7.4 feet by approximately 7.4 feet.

11. A modular building assembly as defined in claim 1 wherein said floor panel is dimensioned approximately 9.6 feet by 7.4 feet.

12. A modular building assembly as defined in claim 1 and further comprising at least one inner wall panel formed to be mounted between said at least one inner building unit and one of said two end building units.

13. A modular building assembly as defined in claim 12 wherein said at least one inner wall panel has at least one of a doorway and a window opening therethrough.

14. A modular building assembly for providing shelter or storage space, comprising:

two adjacent building units, each of said building units having a floor panel, said floor panel having a pair of floor supports extending along a length of an exterior surface of said floor panel, at least one of said floor supports defining a passageway therethrough for receiving air, said floor panel of a first of said two building units formed to abut said floor panel of a second of said two building units so that said passageway of said first and said second of said two building units is able to communicate for passage of air, two side wall panels each having a lower end and an upper end, each of said two side wall panels formed to be releasably mounted to said floor panel, a first of said two side wall panels formed for mounting along a first edge of said floor panel and a second of said two side wall panels formed for mounting along a second edge of said floor panel opposite said first edge of said floor panel, an end panel, said end panel having a lower end and an upper end, said lower end of said end panel formed to be releasably mounted to at least one of a third edge and a fourth edge of said floor panel, and a roof panel having upwardly extending flanges along a first edge and a second edge thereof, said first edge of said roof panel being opposite said second edge of said roof panel, said roof panel formed to releasably mount to and extend over said upper end of said end panel and releasably mount to and extend over said upper end of each of said two side wall panels, said roof panel formed for operably resting atop said upper end of said end panel and said upper end of each of said two side wall panels, said roof panel being substantially planar;

a plurality of side brackets each formed to be releasably mounted to said two side wall panels, each of said side brackets having a lip portion at a first end thereof, said first end formed to be positioned adjacent said roof panel; and a plurality of roof brackets each formed for mating engagement with said upwardly extending flanges of each said roof panel, each of said roof brackets having a lip portion at a first end and a second end thereof, said lip portion of each of said roof brackets formed for interlocking engagement with said lip portion of one of said side brackets.

15. A modular building assembly as defined in claim 14 and further comprising an inner wall panel formed to be releasably mounted to a remaining one of said third edge and said fourth edge of each said floor panel of said first and said second of said two building units, said inner wall panel serving as a wall structure in, and separating an interior of, said first and said second of said two building units.

16. A building unit for providing shelter or storage space, comprising:

a floor panel, said floor panel having a pair of floor supports extending along a length of an exterior surface of said floor panel, said floor supports defining a passageway therethrough for receiving air;

two side wall panels each having a lower end and an upper end, each of said two side wall panels formed to be releasably mounted to said floor panel, said lower end of a first of said two side wall panels formed for mounting along a first edge of said floor panel and said lower end of a second of said two side wall panels formed for mounting along a second edge of said floor panel opposite said first edge of said floor panel;

two end panels each having a lower end and an upper end, said lower end of a first of said end panels formed to be releasably mounted to a third edge of said floor panel and said lower end of a second of said two end panels formed to be releasably mounted to a fourth edge of said floor panel;

a roof panel having upwardly extending flanges along a first edge and a second edge thereof, said first edge of said roof panel being opposite said second edge of said roof panel, said roof panel formed to releasably mount to and extend over said upper end of each of said two end panels and releasably mount to and extend over said upper end of each of said two side wall panels, said roof panel formed for operably resting atop said upper end of each of said end panels and said upper end of each of said two side wall panels, said roof panel being substantially planar;

four side brackets each formed to be releasably mounted to said two side wall panels, each of said side brackets having a lip portion at a first end thereof, said first end formed to be positioned adjacent said roof panel; and two roof brackets each formed for mating engagement with said upwardly extending flanges of said roof panel, each of said roof brackets having a lip portion at a first end and a second end thereof, said lip portion of each of said roof brackets formed for interlocking engagement with said lip portion of one of said side brackets.

17. A method of assembling a building unit, said method comprising the steps of:

providing a floor panel, a plurality of wall panels, a substantially zero-pitch roof panel, a plurality of side brackets, and a plurality of roof brackets;

positioning said floor panel on a ground surface;

mounting a first and a second of said wall panels on adjacent edges of said floor panel to form a first end wall and a first side wall of said building unit;

positioning said roof panel atop upper ends of said first end wall and said first side wall of said building unit;

after said roof panel positioning step, mounting a third and a fourth of said wall panels between said floor panel and said roof panel to form a second end wall and a second side wall of said building unit;

mounting a side bracket to each vertical edge of said first side wall and said second side wall;

mounting a roof bracket to edges of said roof panel located atop said first end wall and said second end wall; and interlocking a lip portion of each said roof bracket with a lip portion of said side bracket positioned for interlocking engagement with said roof bracket.

* * * * *